United States Patent [19]

Akazawa et al.

[11] Patent Number: 4,469,576

[45] Date of Patent: Sep. 4, 1984

[54] APPARATUS FOR ELECTROLYTICAL PRODUCTION OF ALKALINE CHLORATE

[75] Inventors: Toshitada Akazawa; Kohkichi Suzuki; Toshikatu Haga, all of Koriyama, Japan

[73] Assignee: Hodogaya Chemical Company, Ltd., Tokyo, Japan

[21] Appl. No.: 368,122

[22] Filed: Apr. 14, 1982

[30] Foreign Application Priority Data

Apr. 17, 1981 [JP] Japan ..... 56-57123

[51] Int. Cl.[3] ..... C25B 9/00

[52] U.S. Cl. ..... 204/237; 204/269; 204/270; 204/275; 204/278; 204/95

[58] Field of Search ..... 204/237–239, 204/269, 270, 275–278

[56] References Cited

U.S. PATENT DOCUMENTS

| | | | |
|---|---|---|---|
| 3,234,117 | 2/1966 | Rost et al. | 204/278 |
| 3,647,672 | 3/1972 | Mehandjien | 204/284 |
| 3,732,153 | 5/1973 | Harket et al. . | |
| 3,756,933 | 9/1973 | Greenberg | 204/237 |
| 3,775,283 | 11/1973 | Eisele et al. | 204/275 |
| 4,032,426 | 6/1977 | de Nora et al. | 204/95 |
| 4,046,653 | 9/1977 | de Nora et al. . | |
| 4,332,648 | 6/1982 | Spore | 204/270 |
| 4,332,659 | 6/1982 | Spore | 204/278 |

FOREIGN PATENT DOCUMENTS

| | | |
|---|---|---|
| 1567621 | 7/1970 | Fed. Rep. of Germany . |
| 956421 | 1/1950 | France . |
| 2156020 | 5/1973 | France . |

*Primary Examiner*—T. Tung

*Attorney, Agent, or Firm*—Austin R. Miller

[57] ABSTRACT

Disclosed is an improved process for electrolytically producing alkaline chlorate, carried out at an increased temperature by using an apparatus of a column type. The apparatus has a lower electrolysis zone, an intermediate reaction zone and an upper hydrogen-separation zone. The reaction zone has a central hollow section and a circumferential hollow section surrounding the central section. A solution to be electrolyzed is forced to circulate through the three zones by hydrogen gas generated so that the solution is allowed to flow down through the circumferential hollow section in a piston-flow manner after the hydrogen gas is separated from the solution. While the solution is passing through the circumferential section, effective auto-oxidation of hypochlorous acid is attained thereby causing the current efficiency of the electrolysis to be improved.

4 Claims, 6 Drawing Figures

APPARATUS FOR ELECTROLYTICAL PRODUCTION OF ALKALINE CHLORATE

BACKGROUND OF THE INVENTION

The present invention relates to an improved process and apparatus for electrolytically producing alkaline chlorate wherein effective auto-oxidation of hypochlorous acid is attained thereby causing the current efficiency of the electrolysis to be improved.

The conventional process of electrolytically producing alkaline chlorates from an aqueous solution of alkaline chloride includes two main steps, that is, an electrolysis step and an auto-oxidation step. In the electrolysis step, chlorine ions in the alkaline chloride solution discharge electrons at an anode, whereby hypochlorous acid ions are produced, while hydrogen ions are reduced at a cathode to form hydrogen gases. In the auto-oxidation step, the produced hypochlorous acid is auto-oxidized to form chlorates.

However, the above process is accompanied by sub-reactions which lead to a decrease in the current efficiency. In the sub-reactions, some of the produced hypochlorous acid is oxidized by the discharge of electrons at the anode to form chlorates with oxygen being generated, while the remaining hypochlorous acid is reduced back to chlorine ions when the oxygen is removed at the cathode.

In order to prevent such disadvantageous sub-reactions from occurring, adjustment of the pH value of the solution, utilization of improved anode materials, addition of chromates and so on have been attempted in conventional electrolysis processes. However, using such methods, a current loss (decrease in the current efficiency) of about 3~8% occurs at the anode and a current loss of 2~4% occurs at the cathode.

In general, apparatuses for electrolytically producing alkaline chlorate have been used, wherein the electrolysis, auto-oxidizing reaction, gas-separation and cooling are effected concurrently within a single unit. Such a single unit is referred to as a "box type" electrolysis vessel. Such box type apparatuses are relatively flat with a large bottom surface area, and because of this a back mix flow reaction is likely to occur causing a low efficiency of the electrolytical production. Further, it is necessary that the electrolysis operation be carried out at a reduced or low temperature in order to protect the apparatus against corrosion. This results in a great amount of electric power being consumed.

There have been attempts or suggestions to improve the process and apparatus for the electrolytical production of alkaline chlorate. However, insofar as is known, there is no process or apparatus which is satisfactory on an industrial scale. For example, referring to U.S. Pat. No. 3,539,486 corresponding to Japanese patent application (Publication No. 51-30035), an apparatus which may be referred to as "a pipe line type apparatus", is disclosed comprising an electrolysis vessel and a reaction vessel connected to each other by conduit pipes, wherein a solution is forced to circulate by the lifting force of the hydrogen bubbles released during the electrolysis. The disclosed apparatus has many disadvantages. Since there are many pipe joints, there is a problem of leakage of the solution from the pipe arrangement. The electrolysis vessel and the reaction vessel are arranged spaced apart from each other, which leads to an increased area of floor space being occupied by the apparatus. With such a pipe arrangement, corrosion is likely to occur and, thus, it is necessary that the apparatus be made of expensive anti-corrosive materials, such as titanum, teflon and the like.

Another published Japanese patent application (Publication No. 52-30960) discloses an apparatus comprising a box type reaction vessel in which an electrode cell is mounted onto an inside wall surface of the vessel and a vertical partition, surrounding the cell on the wall is also mounted onto the inside wall surface of the vessel to separate the vessel space into two sections. A solution in the vessel is forced to circulate between the two space sections separated by the partition. Such an arrangement does not allow the vessel to contain a great amount of the solution therein, and leads to a non-uniform circulation of the solution. This results in the reaction space defined by the vessel and the partition, not being fully utilized to effect the necessary reaction. Further, the apparatus has disadvantages in that the base of the apparatus is relatively large, since it is of a box type of a relatively flat form. Still further, the electrolysis operation cannot be carried out at an increased temperature, since the apparatus is constructed of a hard polyvinyl chloride or the like.

In the above mentioned two kinds of conventional apparatuses, that is, a pipe line type and a box type, the electrolysis temperature is still low, that is, 60° to 80° C., and, thus, the advantages of a high temperature operation cannot be enjoyed. Also, the apparatuses still have to be equipped with a cooling system, which causes the apparatuses to have a complicated structure.

SUMMARY OF THE INVENTION

An object of the present invention is to provide a process and an apparatus for electrolytically producing alkaline chlorates, improved so as to remove the above disadvantages, wherein the auto-oxidation of hypochlorous acid is accelerated effectively with an increased current efficiency at an increased reaction temperature.

According to the present invention, there is provided a process of electrolytically producing alkaline chlorate from an aqueous solution of starting materials in at least one cyclic system, comprising:

(a) forming, as elements of the cyclic system;

a lower electrolysis zone, comprising an electrode section including vertical cathodes and vertical anodes arranged alternately and spaced apart from each other, and a feed section, outside of said electrode section, communicating with the bottom portion of said electrode section;

an intermediate reaction zone, located above said lower electrolysis zone, comprising a central hollow section, communicating with the top end of said electrode section and allowing the solution to rise upwardly from the top end of said electrode section, and a first circumferential hollow section surrounding said central hollow section and communicating with said feed section at the top thereof, so that the below-mentioned gas-separated solution is allowed to flow through said circumferential hollow section toward said feed section in a piston-flow manner;

an upper hydrogen-separation zone communicating with said intermediate reaction zone at the top open ends of said central and circumferential hollow sections for separating the hydrogen gas produced by the electrolysis of the solution and discharging the separated gas out of the system, the solution being forced by bubbles of the produced hydrogen gas to circulate through said electrode section, said central hollow section, said upper hydrogen-separation zone, said circumferentially hollow section and said feed section, in this order;

(b) feeding continuously into the cyclic system a starting aqueous solution containing alkaline chloride of an electrolyte, alkaline chlorate and alkaline chromate;

(c) applying a voltage between said cathodes and anodes in said electrode section to electrolyze the solution therein with a 10 to 30 A/dm$^2$ current density and a 10 to 30 A/l current concentration at a temperature of 80° to 115° C., thereby to produce the hydrogen gas bubbles in the solution;

(d) continuously removing the hydrogen gas from the top end of said upper hydrogen-separation zone;

(e) discharging the solution continuously out of the system, so that a free surface of the circulating solution in the system is kept at a constant level; and (f) maintaining the circulating solution at a composition including 50 to 300 g/l of alkaline chloride, 100 to 850 g/l of alkaline chlorate and 3 to 10 g/l alkaline chromate.

Hydrochloric acid is added to the solution so that the circulating solution is kept at a pH valve of 5.5 to 6.4 during the electrolysis operation.

Preferably, the hydrochloric acid is dosed onto the free surface of the solution at a central portion thereof, said central surface portion facing the top open end of said central hollow section.

It is preferred to electrically connect said lower electrolysis zone with said intermediate reaction zone, so that cathodic protection is attained, thereby preventing rust from forming.

In the above process, auto-oxidation of hypochlorous acid produced by electrolysis is effected, while the solution is flowing in the piston-flow manner through said circumferential hollow section.

According to another aspect of the present invention, an apparatus is provided for carrying out the above process. The apparatus comprises a container of a column type in which there is a lower electrolysis zone having an electrode section and a feed section, an intermediate reaction zone having an elevating section and a descending section forming a piston-flow reactor and an upper gas separation zone, said electrode section comprising vertical cathode plates and vertical anode plates arranged alternately and spaced apart from each other, said cathode plates upwardly extending from the bottom wall of said column, said anode plates extending horizontally from the side wall of said column between the neighboring cathode plates, the respective cathode plates having horizontal holes across them so that said holes form, in combination, a horizontal through-hole across said electrode section, said anode plates being positioned above said through-hole, said feed section being divided by said electrode section and the side and bottom walls of said column to form two symmetrical opposite areas outside of said electrode section, which areas are connected to each other through said horizontal straight passage, said elevating section being defined by a tube extending vertically along the axis of said column, said tube having upper and lower open ends with an enlarged lower portion of a reverse funnel form covering the top area of said electrode section, said descending section being defined by said tube and the side wall of said column to form a circumferential area extending vertically around said tube and having an inlet for introducing the starting solution and an outlet for discharging the solution out of said column, said descending section communicating with said feed section at the top thereof, said upper section being defined by the side and top walls of said column to form a circular area and having an outlet at the top wall of said column for discharging gases produced from the solution in said column, wherein the ratio of the height of said column to the diameter thereof is not less than 2.

The lower edges of said holes of said cathode plates being defined by the bottom plate of said column, said horizontal straight passage lying on a vertical plane, perpendicular to said cathode and anode plates, on which plane lie the axes of said column lines. Two cathode plates are fixed opposite each other on the wall of the enlarged lower end of said tube.

The present inventors have sought to achieve an improved process and apparatus for electrolytically producing alkaline chlorate by taking into consideration the following conditions:

(1) The operation is carried out with the electrolyte solution kept at a temperature as high as possible.

(2) The pH value of the solution, having a high temperature, is kept in an appropriate range.

(3) The reaction zone where hypochlorous acid is converted to chlorate is designed so as to function efficiently.

The realization of such process and apparatus relies on effectively accelerating the auto-oxidation of hypochlorous acid.

The auto-oxidizing reaction is effected according to the following formula.

$$2HClO + ClO^- \rightarrow ClO_3^- + 2HCl$$

Hypochlorous acid ions are produced by the discharge of chlorine ions at the anode, and these acid ions are auto-oxidized to form chlorates. According to the inventors' experiments, the rate of this reaction was confirmed to be about three powers of the entire concentration of the hypochlorite and hypochlorous acid, and it was confirmed that the optimum reaction was attained when the mol ratio of hypochlorite to hypochlorous acid is 2:1. Further, from the above experiments, the inventors have found that the optimum auto-oxidation of hypochlorous acid to chlorates can be effected in a piston-flow or plug-flow reactor, not in a back mix flow reactor. In an ideal back mix flow reactor, the contents are well stirred so that they become uniform in composition throughout, and, thus, the exit stream from the reactor has the same composition as the fluid within the reactor. Contrary to this, in an ideal piston flow reactor, the various fluids are not mixed so that the flow of these fluids through the reactor is orderly. Consequently, no diffusion along the flow path occurs and no difference in velocity for any of the flowing fluids occurs. In other words, there is no mixing of fluids within the flow path, and the resident time in the reactor is the same for each type of fluid.

Still further, it has been found that the optimum reaction is attained at a pH value in the range from 5.5 to 6.4, preferably from 5.8 to 6.1.

As a result of the inventors' investigation concerning the effects of the reaction temperature, it has been found that an activation energy for the reaction is 16~18 Kcal/mol (according to the Arrhenius plotting method), and the reaction rate is 65 times greater than the conventional rate when the operational temperature is increased, for example, from the conventional temperature of 40° C. to 100° C.

On the basis of the above observations, the present inventors have investigated means for achieving an effective auto-oxidizing reaction and have arrived at the present invention.

The present invention is characterized by the following.

(1) The apparatus is of a column type with an increased height and a reduced diameter from that of a conventional apparatus. The column comprises a lower electrolysis zone, an intermediate reaction zone and an upper gas-separation zone, successively.

(2) An electrolyte solution containing hypochlorous acid of an increased concentration, generated in an electrode cell or section provided in the lower electrolysis zone, is forced, by the lifting force of the hydrogen bubbles generated, to be discharged through a shoot and a draft tube integrated with the shoot to the center of the upper gas-separation zone where the solution is released from the hydrogen gas.

(3) The gas-separated solution is forced to descend through a circumferential passage, defined by the draft tube and the side wall of the column, in a piston-flow manner, where the auto-oxidizing reaction is effected.

(4) The resultant solution, in which the concentration of hydrochlorous acid is reduced (diluted), is forced back into the electrode cell.

(5) A starting or feeding solution is continuously fed into the column, and the solution in the column is discharged continuously out of the column, causing the circulation of the solution to be continuous in the column during the electrolysis operation.

Another feature of the present invention directed to the dimensions of the apparatus resides in that the ratio of the height of the column to the diameter thereof is not less than 2. If the ratio is less than 2, no effective auto-oxidizing reaction takes place and, thus, the current efficiency is reduced or a back mix reaction takes place.

In practice, the electrolysis zone of the column is designed with the minimum diameter allowed and then the volume of the solution to be held in the column is determined from the required current concentration. As a result, the height of the column is determined according to the ratio that the height to the diameter is not less than 2.

The electrolysis according to the present invention takes place under the following conditions: The feed solution includes 50 to 300 g/l of alkaline chloride, 100 to 850 g/l of alkaline chlorate and 3 to 10 g/l of alkaline chromate. The current density is 10 to 30 A/dm$^2$ and the current concentration is 10 is 30 A/l. When the concentration of alkaline chloride is less than the above critical value, the volume of oxygen generated is increased to such an extent that the anode is damaged by the resultant oxygen. When the concentration of alkaline chloride is higher than the above critical value, alkaline chloride is crystalized and separated from the solution, whereby the electrolysis operation becomes ineffective.

As to the concentration of alkaline chlorate, the lower limitation is determined by the transformation from alkaline chloride to alkaline chlorate. The upper limitation is determined by the critical concentration whereby no crystalized chlorate becomes separated.

According to the present invention, the same apparatus may be used in series, that is, in a cascade arrangement or in a parallel arrangement. In the cascade arrangement, (normally including 5 to 10 cascades), the concentrations of alkaline chloride and alkaline chlorate are different among the cascaded units and determined by the difference in the positions of the cascades within the apparatus. It should be designed so that the output from the final stage of the apparatus includes alkaline chloride having a concentration as low as possible and alkaline chlorate having a concentration as high as possible.

As to the concentration of alkaline chromate, when it is lower than the above-mentioned critcal level, the cathode loss is increased, with the effect that the formation of rust is likely to occur, that is the cathodic protection is reduced. When it is higher than the above-mentioned critical level, production of oxygen at the anode is increased, which reduces the current efficiency.

Since a lower current density necessitates the use of larger equipment and a higher current density necessitates the use of greater electric power per unit of production, a critical current density from 10 to 30 A/dm$^2$ is preferable. Also, a lower current concentration necessitates the use of larger equipment and a higher current concentration leads to the higher concentration of alkaline hypochlorite and, thus, a reduced current efficiency.

The pH value of the reactive solution may be in the range from 5.5 to 6.4, preferably from 5.8 to 6.1. When the pH value is lower than the above critical value, the chlorine content in the gases generated is increased to such an extent that a dangerous explosive reaction of $Cl_2$ with $H_2$ may occur. Further, in this case, a load necessary for carrying out a subsequent gas-purifying process is increased. When the pH value is over the above critical value, the volume of oxygen generated is increased to such an extent that a dangerous explosive reaction of $O_2$ with $H_2$ may occur. This also leads to a reduced current efficiency.

According to the present invention, electrolysis takes place when the solution has not been forceably cooled, but when the solution is at a high temperature of 80° to 115° C. The upper limit of 115° C. is close to the boiling point of the solution during the operation. When the temperature is lower than the above-mentioned lower limit, this leads to an increase in the electric power per unit of production. Further, in this case, the amount of the vapour generated is reduced and, thus, the concentration of alkaline chlorate cannot be increased.

According to the conditions of the present invention, the electrolysis operation can be carried out effectively with a reduced concentration of hypochlorous acid in the range from 0.3 to 1.5 g/l (calculated on the basis of HClO).

PREFERRED EMBODIMENTS OF THE PRESENT INVENTION

Figure 1:
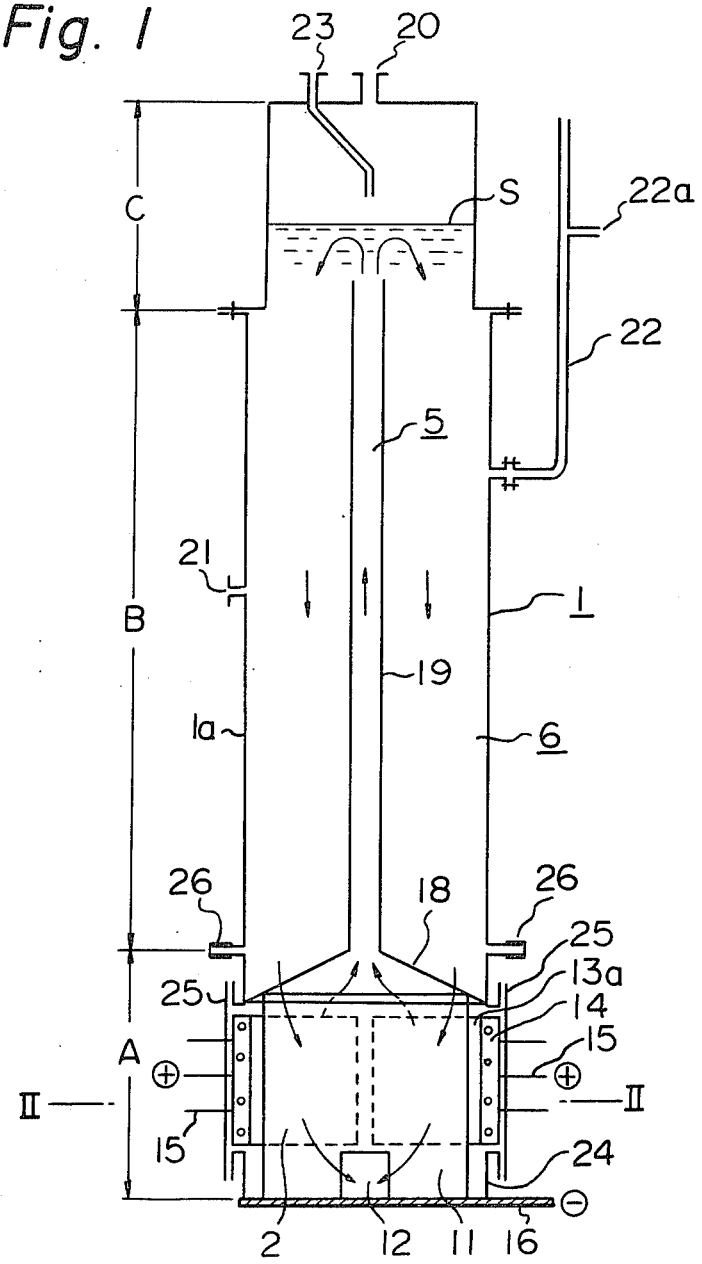
FIG. 1 is a diagrammatic view of a sectional elevation indicating one embodiment of an apparatus in accordance with the present invention.
Figure 2:
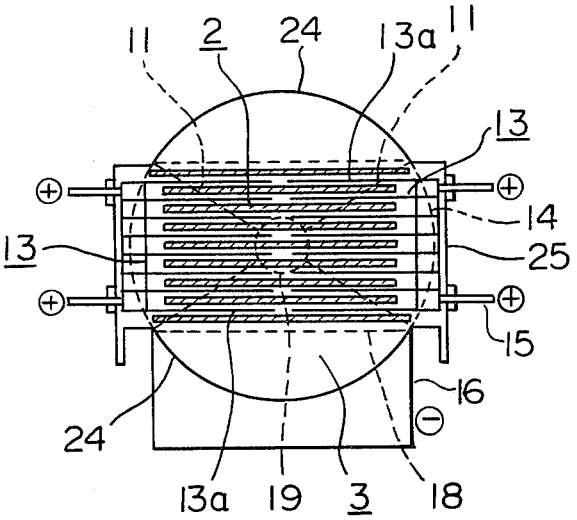
FIG. 2 is a cross sectional view of the apparatus taken along the line II—II in FIG. 1.

Referring to FIGS. 1 and 2, an apparatus for the electrolytical production of alkaline chlorates, according to the present invention, has a column type container. The column 1 forms successively a lower electrolysis zone A, an intermediate reaction zone B and an upper gas-separation zone C. The lower zone A has a cathode vessel 24 forming an electrode cell or section 2 and a feed section 3. The electrode section 2 comprises vertical cathode plates 11 equally spaced apart from the neighboring ones and extending upwardly from the bottom of the cathode vessel 24. The electrode section 2 also includes two symmetrical comb-like anodes 13, each having an anode frame 14 and vertical anode plates 13*a* extending horizontally from the anode frames 14. These comb-like anodes 13 are disposed opposite each other in the lower zone A, in such an arrangement that the corresponding anode plates 13*a* are located between the neighboring cathode plates 11, so as to be spaced apart from each other at their inner ends and from the neighboring cathode plates. The comb-like anodes 13 are spaced apart from the bottom wall of the column. The cathode plates 11 have holes 12 across the width. In this embodiment, the lower edges of the holes are defined by the bottom wall of the column 1. These holes, in combination, form a horizontal straight passage in the electrode section 2, intersecting with the axis of the column 1. The anode plates 13*a* are positioned so as to be above the straight passage. In the above arrangement, the comb-like anodes 13 are electrically insulated from the cathode vessel 24.

The feed section 3 is defined by the electrode section 2 and the side and bottom walls of the column 1 to form two symmetrical opposite spaces outside of the electrode section 2. The two spaces are communicated with each other through the straight passage mentioned above.

The intermediate zone B has an elevating section 5 extending upwardly from the electrode section along the axis of the column 1 and a descending section 6 surrounding the elevating section 5. The elevating section 5 is defined by a draft tube 19 and a chute 18 connected thereto. The chute 18 is of a reverse funnel form covering the top area of the electrode section 2 and is fixed to the cathode plates 11, which are located opposite each other on the outermost area of the electrode section.

The descending section 6 is defined by the tube 19 and the circular side wall of the column 1 to form a circumferential space extending vertically around the tube 19, and has an inlet nozzle 21 for introducing the starting material solution and an outlet pipe 22 for discharging the solution out of the column 1, both pipes being located opposite each other at the side wall of the column 1 with the inlet nozzle 21 positioned at a level lower than that of the outlet pipe 22. The descending section 6 communicates with the feed section 3 at the top thereof.

The upper zone C is defined by the side wall and top wall of the column 1 to form a circular area and has an outlet pipe 20 at the top wall of the column 1 for discharging gases produced from the solution in the column 1. The circumferential area of the descending section 6 is integrated with the area of the upper zone C and the tube 19 of the elevating section 5 is open to the upper zone area.

In the above arrangement, when the electrolysis operation is carried out, a solution from the inlet nozzle 21 is forced to descend and flow into the feed section 3. The introduced solution is fed into the elevating section 5 through the horizontal straight passage formed by holes 12 of the electrode section 2. In the electrode section 2, the fed solution is subjected to electrolysis, by which bubbles of gases (mainly hydrogen gas) are produced. The resultant solution is forced by the produced gas bubbles to elevate, together with the gases, from the chute 18 toward the upper zone C through the tube 19. The elevating solution overflows from the top open end of the tube 19 into the descending section through the upper zone C. When the solution over-flows from the tube 19, the gases are separated from the solution and are discharged out of the column 1 through the gas outlet pipe 20. The gas-separated solution descends through the descending section 6 toward the feed section 3. On the way to the feed section 3, the solution is partially discharged out of the column 1 through the outlet pipe 22.

The outlet pipe 22 is open to the atomosphere, and the upper zone C is also open to the atmosphere. The outlet pipe 22 has a branch pipe 22*a* which is positioned at a predetermined level close to that of the top open end of the tube 19. In this connection, while the solution is continuously fed from the inlet nozzle 21 and discharged from the branch pipe 22*a*, the free surface S of the solution held in the column is kept at the same level as the above predetermined level. The free solution surface S may be either above or below the top open end of the tube 19.

In the above arrangement, the solution is ensured to descend through the descending section 6 in a piston-flow manner. Therefore, if specific reactions take place in the solution descending through the descending section 6, the concentrations of the reactants are reduced as the solution descends.

The solution in the column is forced, by the bubbles of the gases produced, to circulate through the electrode section 2 in the lower electrolysis zone A, the elevating section 5 in the intermediate zone B, the upper gas-separation zone C, the descending section 6 in the intermediate reaction zone B and the feed section 3 in the lower zone A. The upper gas-separation zone C has a conduit 23 extending from the top wall of the column into the upper zone C. The lower open end of the conduit 23 is designed so as to be positioned above the top open end of the tube 19.

Figure 6:
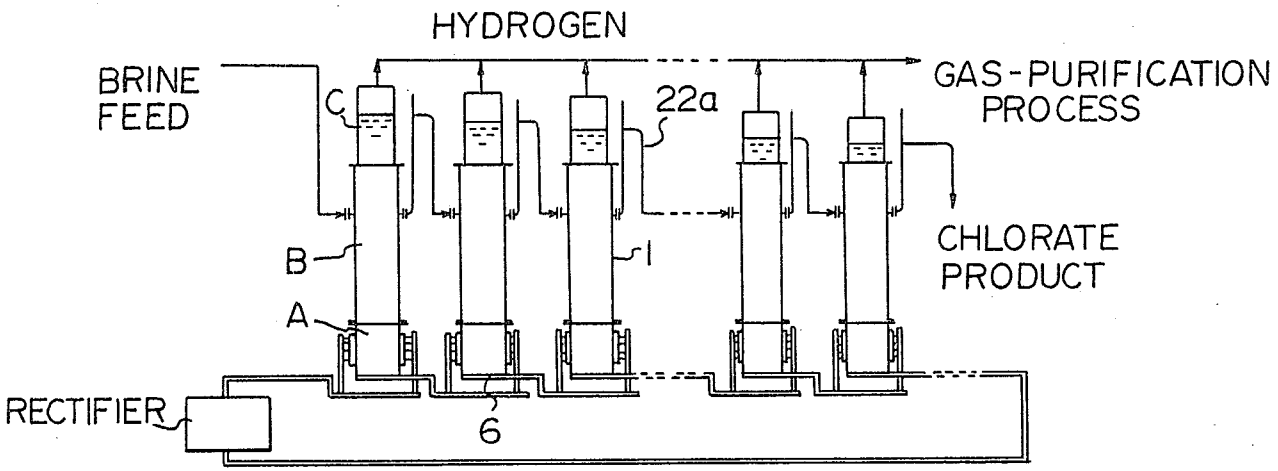
FIG. 6 is a diagrammatic view indicating a cascade arrangement of the apparatus according to the present invention.

In the drawings, numeral 15 denotes electric terminals of the anodes, and numeral 16 denotes an electric lead of the cathode in a plate form. The cathode lead plate 16 is attached to the bottom wall of the column 1, and is designed so as to be connected to the corresponding lead plate of an adjacent apparatus, if used in a cascade system as indicated in FIG. 6. Numeral 26 denotes copper strips electrically connecting segments of the column 1 at a joint flange thereof so that cathodic protection is attained.

Numeral 25 denotes a cover plate for closing holes of the lower zone of the column, through which holes the two comb-like anodes 13 are inserted in the cathode vessel 24.

In the above mentioned apparatus, it should be noted that the lower electrolysis zone A, formed by the cathode vessel 24, in which the two comb-like anodes 13 are disposed opposite each other, the intermediate reaction zone B, formed by the cylindrical wall and the tube, and the upper gas-separation zone C, formed by the cylindrical wall, are successively connected to form a column. However, it is not necessary for the diameter of the upper gas-separation zone C to be the same as either of the diameters of the other zones. For example, it is desireable to reduce the area of the gas-separation zone C from the standpoint of safety. In this respect, the diameter of the gas separation zone C may be reduced, preferably to the minimum level which is allowed. The diameter of the electrode zone A is determined from the minimum area of the zone A which must contain a cathode and anode arrangement having the necessary dimensions. The height of the column 1 is determined from the required reaction area, that is, the required volume of the solution to be held in the column 1.

In this respect, in a case of an electrolysis apparatus having a usual current capacity of 50 KA, the diameter of the column is preferably 1 to 1.2 m, with a height of 3.5 to 5 m. However, in this case, the diameter of the gas-separation zone is preferably 0.7 to 0.8 m. In other cases, the upper limit of the height of the column is about 10 m, from the view-point of resisting the pressure of the electrolysis zone.

The holes 12 of the cathode plates 11 may be of a rectangular form and are designed to have a dimension of 3 to 20 $cm^2/1000/A$, preferably 5 to 15 $cm^2/1000$ A. If the dimension of the holes 12 is smaller than the above lower limitation, a smooth circulation of the solution in the column is not ensured.

According to the apparatus having the above mentioned preferable dimensions, wherein the diameter of the column is relatively small and the height of the column is relatively large, the solution is ensured to flow through the descending section 6 at a temperature changing slightly along the flow direction without mixing of the different fluids. As a result, no mixing of the components of the solution occurs due to the difference in specific weights of the components, and thus the piston-flow of the solution is ensured in the descending section.

The electrode section 2, the chute 18 and the draft tube 19 all have to be sealed from the descending section 6, in order to prevent leakage of the solution, which would lead to the destruction of the piston-flow of the solution and also to prevent leakage of the solution from the descending section into the elevating section, without passing through the electrode section 2, which leakage would cause the concentration of hypochlorous acid to be reduced in the elevating section 5.

The inner diameter of the draft tube 19 should be determined according to the value of the electrolysis current. However, generally speaking, such diameter may be in the range from 100 to 250 mm. The upper open end of the tube 19 may be positioned not more than 100 mm above the free surface S of the solution in the descending section 6 or not more than 300 mm below the free surface S. The upper end of the tube 19 is located in the center of the upper gas-separation zone C, so that the solution is forced to flow radially out of the upper open end of the tube 19, and, thus, is distributed uniformly over the top circumferential area of the descending section. This enhances a so-called "volume efficiency" of the auto-oxidation of hypochlorous acid, that is, the efficiency of the auto-oxidation per unit volume of the solution is increased.

In connection with the above, the inventors have investigated the relationship between the diameter of the apparatus and the volume efficiency, comparing the conventional box type apparatus with the column type apparatus of the present invention.

Figure 3:
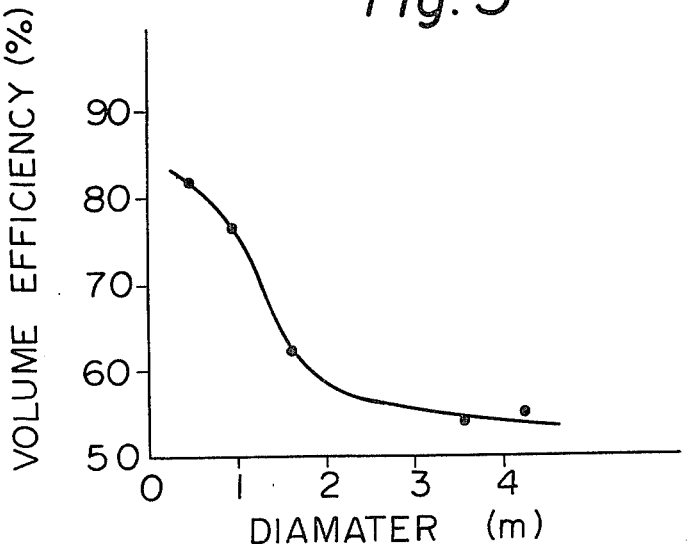
FIG. 3 is a diagram showing the volume efficiency according to the diameter of the apparatus.

The result is shown in FIG. 3. As is apparent from FIG. 3, the volume efficiency is reduced as the diameter of the apparatus increases, and in an apparatus having a diameter over 2 m, only half the volume of the solution held in the apparatus contributes to the auto-oxidation. This implies that a back mix flow reaction is likely to take place as the diameter of the apparatus increases.

In this respect, the smaller the diameter, the better. However, with the column type apparatus of the present invention, the diameter may be in the range from 0.5 to 1.3 m in order to contain the necessary volume of the solution in the apparatus. Preferably, the diameter should be 0.5 to 1.0 m. If a large scale apparatus in the same arrangement as shown in FIG. 1 having a diameter over 1.3 m is employed, it is preferable to modify the apparatus, so as to elongate the length of the passage, through which the solution is forced to descend while the auto-oxidation is taking place, with the cross-sectional area of the passage being reduced. Such modification, for example, is shown in FIG. 4 and FIG. 5.

Figure 4:
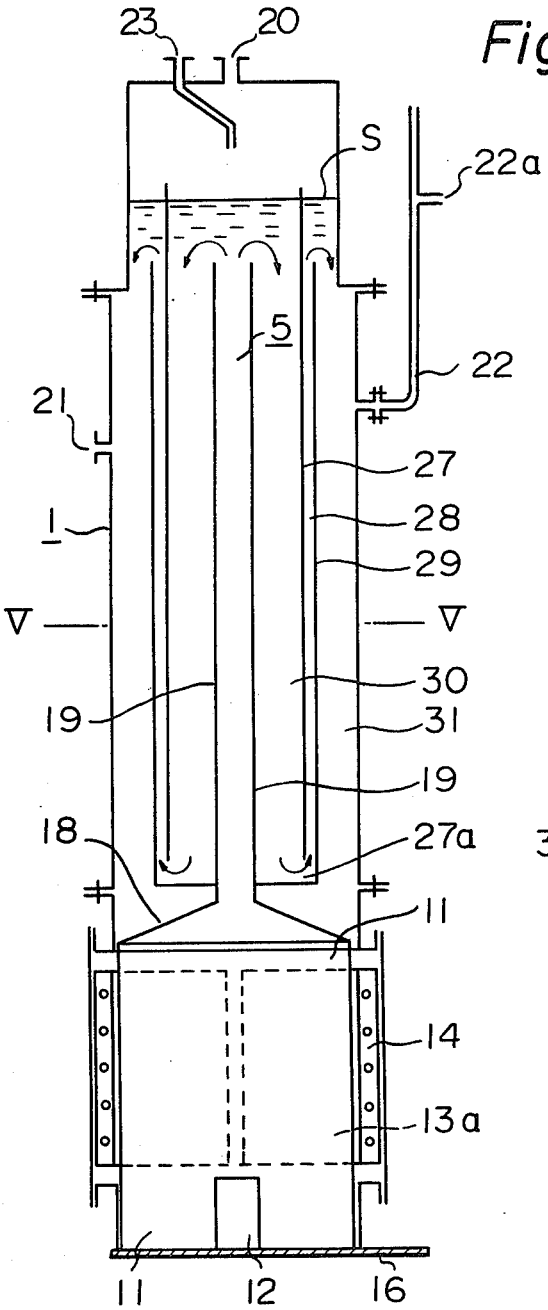
FIG. 4 is a diagrammatic view corresponding to FIG. 1, indicating another embodiment of the apparatus of the present invention.
Figure 5:
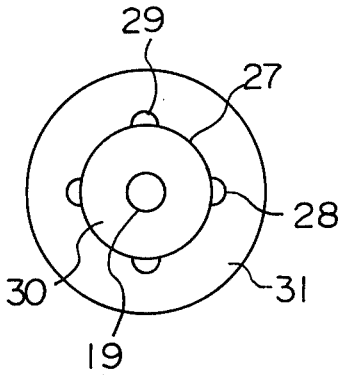
FIG. 5 is a cross sectional view of the apparatus taken along the line V—V in FIG. 4.

Referring to FIGS. 4 and 5, an apparatus having substantially the same arrangement as shown in FIGS. 1 and 2, with a modification made in the intermediate reaction zone, is provided. Therefore, the same numerals in FIGS. 1, 2, 4 and 5 denote substantially the same elements or members. The modified apparatus has a cylindrical vessel 27 enclosing the draft tube 19 and being coaxial therewith, thereby to form an inner local passage 30. The cylindrical vessel 27 has a lower end and an upper open end. Vessel 27 has four openings 27*a*, at the lower end, equiangularly spaced apart. The upper end of the vessel 27 is positioned above the upper end of the tube 19. Four partitions 29, of a vertical extension having a semi-circular cross section, are mounted onto the outside of the vessel 27, thereby to form intermediate local passages 28. Lower ends of the partitions 29 are integrated with the lower end of the vessel 27, in such an arrangement that the inner local passage 30 communicates with the respective intermediate passages 28 through the openings 27*a*. Upper ends of the partitions 29 are positioned at the same level as that of the upper end of the draft tube 19. An outer local passage 31 is defined by the side wall of the column 1, the partitions 29, the vessel 27, the draft tube 19 and the chute 18. The height of the vessel 27 is designed so that the solution circulating in the column 1 is prevented from entering the outer local passage 31. With the above modified arrangement of the intermediate zone B, the solution is forced to flow from the upper end of the tube 19 into the inner local passage 30 and descend through the passage 30 in a piston-flow manner and then flow into the intermediate local passages 28 through the openings 27*a*. The solution is forced to elevate through the intermediate local passage 28 and then flow from the upper end of partitions 29 into the outer local passage 31. The solution then descends through the outer local passage 31 in a piston-flow manner toward the feed section 3.

The above modification of the intermediate reaction zone B leads to an increase in the volume efficiency.

In the above modified arrangement, the cylindrical vessel 27 may be disposed in the reaction zone B with a pipe therein, so that the inner local passage 30 is formed between the draft tube 19 and the pipe and an intermediate local passage 28 is formed between the vessel and the pipe. In this case, the resultant intermediate local passage 28 has a circumferential sectional view. The vessel may be partially with the pipe, in a cross-sectional view, so that integrated separate intermediate local passages, corresponding to those shown in FIG. 5, are formed.

For comparison, the inventors carried out a test in which the apparatus of the present invention, employed in example 1 described hereinafter, was operated under the same conditions as those applied in a conventional box type apparatus. The conditions are: current of 9000 A; current density at anode of 18.8 A/dm$^2$; temperature of 55° C.; NaCl of 100 g/l; $NaClO_3$ of 480 g/l; $Na_2CrO_4$ of 3.7 g/l; and pH of 6.7. The volume efficiency was determined by using a ratio of the obtained amount of the auto-oxidized product from hypochlorous acid to the theoretical value thereof. The resultant volume efficiency was 86%. In marked contrast, the corresponding volume efficiency of the conventional box type apparatus was 55%. These data show the fact that, according to the present invention, a required reactive volume of the solution, that is, a necessary volume of the solution to be circulated in the column can be reduced by about 30 to 40%, relative to that of the conventional box type apparatus.

During the electrolysis operation, the pH value of the solution was increased due to the electrolysis reaction. In this respect, it is necessary to adjust the pH value to a predetermined range by dosing a mineral acid to the solution. According to the present invention, aqueous hydrochloric acid is preferably dosed onto the free surface of the solution from the dosing conduit 23. By this dosing operation, the solution is kept at a pH value in the range from 5.5 to 6.4, preferably 5.8 to 6.1.

In order to attain effective auto-oxidation of hypochlorous acid, it is desirable to dose hydrochloric acid into a local zone of the solution where the solution is stirred intensively by the bubbles of hydrogen gas or the like, which bubbles are then separated and discharged out of the column. This local stirred zone of the solution is just above the upper open end of the draft tube. If hydrochloric acid is dosed into another local portion of the solution where the solution flows slowly, for example, in a portion of the solution in the descending section, the solution becomes locally acidic at that portion. This causes the dosed hydrochloric acid to dissolve to form explosive chlorine dioxide gas. Particularly, where the pH value is reduced to about 6.0 at a high temperature of not less than 80° C., it is very necessary to dose hydrochloric acid into the portion of the solution where the solution is stirred or mixed the most intensively.

According to the present invention, the apparatus is provided with means for thermal insulation so that the increased temperature of the solution in the column can be kept in the range from 80° to 115° C., preferably 90° to 110° C. with a minimum loss of thermal energy generated by the electrolysis. This is an effective utilization of the thermal energy which, otherwise, becomes a loss of electric power during electrolysis. As a result, the electrolysis operation can be carried out under a reduced voltage applied to the electrodes.

In connection with the above, it should be noted that the present invention features no provision of means for cooling the lower electrolysis zone and, in turn, electrolysis takes place with the solution at a high temperature. Such a high temperature electrolysis operation accelerates the auto-oxidation reaction of hypochlorite thereby improving the current efficiency. Further, an amount of the vapor carried by the produced hydrogen gas is increased and, thus, the concentration of alkaline chlorate is increased. This leads to a reduction in the amount of water to be removed in the vapor phase from the output solution in the subsequent vaporing process whereby the produced chlorate is separated from the electrolyte. However, a problem may occur, particularly in a cascade system of a plurality of the column type apparatus as shown in FIG. 6, wherein condensation of the solution may be excessively accelerated so that alkaline chloride and/or alkaline chlorate is crystalized and separated from the solution. To cope with this problem, it is necessary to strictly control the temperature of the solution or vapor pressure and the concentration of the output solution from each cascade unit by adjusting the amount of water derived from the input solution and the dosed aqueous hydrochloric acid to be added in each apparatus unit. Such control ensures a stable operation of electrolysis.

The cathode vessel 24 and the cathode plates 11 forming the lower electrolysis zone A are made of iron or an iron alloy. However, these iron members are prevented from being corroded owing to the electrolysis current. The covering plates 25 to close the openings through which the comb-like anodes 13 are inserted are made of an iron material. It is advantageous to connect these electrically to the cathode vessel 24 by copper strips 26, thereby to effect cathodic protection. In this case, it is preferable to employ copper strips having a thickness of 3 to 5 mm and a width of 50 to 100 mm. It is preferred that at least four copper strips be used and located so as to be equally spaced apart from the neighboring ones along the circumference of a flange joining the column segments.

Due to the provision of means for cathodic protection, as mentioned above, expensive anti-corrosive materials, such as titanium or teflon are no longer required for members forming the apparatus of the present invention. These expensive materials are required in a conventional apparatus to be operated at a relatively high temperature. Also, it is possible for the apparatus of the present invention to be made of iron.

The effect of the cathodic protection relies on specific factors, such as cathode current density, the concentration of chromate, the area to be cathodic-protected and the concentration of hypochlorous acid. However, the column type apparatus of the present invention is of a simple construction or arrangement and includes constructive members having relatively small areas to be cathodic-protected, where the solution contacts the members.

In this respect, the current density in the above mentioned range is enough to attain effective cathodic protection. In general, if the concentration of hypochlorous acid is high, the cathodic reduction reaction tends to occur at the surface of the member to be cathodic-protected, with the result that the electric potential becomes adequately high or noble to promote corrosion of the surface of the member.

However, it is noted that, according to the present invention, since the concentration of hypochlorous acid is extremely low and the concentration of chromate is kept at a high level of 5 to 10 g/l, the surface of the member to be cathodic-protected is coated with a thick layer formed thereon, which layer prevents the reduction of hypochlorous acid from occurring, thereby attaining an effective protection of the iron members employed in the apparatus.

The following is a summary of the advantages of the column type apparatus and process of producing electrolytically alkaline chlorate according to the present invention.

(1) The electrolysis, the gas-separation and the auto-oxidation reaction take place effectively. Particularly, the configuration of the reaction zone is suitable for the auto-oxidation of hypochlorous acid.

(2) Since the apparatus is operated at a high temperature without being forceably cooled, a reduced voltage can be applied with the result that a reduced amount of electric power is consumed.

(3) Since the high temperature operation leads to promotion of vaporization of the solution so that a high concentration of chlorate can be obtained, thermal energy, for use in vaporizing the condensed chlorate solution in a subsequent crystalization process, can be greatly saved.

(4) Since the apparatus is of a column type construction having a large height and a small diameter, not of a box type construction, the base area on which the apparatus is installed can be reduced.

(5) Since the liquid contacting portion of the reaction zone can be cathodic-protected, it is possible to employ less expensive iron as a material in the reaction zone. In this respect, the amount of expensive titanium and/or teflon to be used in the apparatus can be greatly reduced, in comparison with the conventional apparatus.

EXAMPLE

A column type apparatus as shown in FIGS. 1 and 2 with the following details was employed.

The cathode vessel 24 of soft iron was provided therein with eleven sheets of cathode plates 11 having rectangular holes, at the central bottom portion, each plate 11 having a height of 15 cm and a width of 8 cm. The cathode plates 11 were welded to the bottom surface of the vessel 24. The two comb-like anodes 13, each having ten sheets of vertical anode plates 13*a* having a width of 0.26 m and a height of 0.6 m (effective area: 24 $dm^2$), were made of expand titanium with a covering layer of a mixture of oxides of ruthenium and iridium. The comb-like anodes 13 are combined with the cathode plates 11 in such an arrangement that the two comb-like anodes 13 were located oppositely with each anode plate 13*a* positioned between the neighboring cathode plates 11 with a gap of 0.25 cm between each anode plate and the adjacent cathode plate. The chute 18 of teflon with a thickness of 2 mm, covering the top area of the electrode section 2, was fixed to the cathode plates which were fixed opposite each other.

To the above arrangement forming the electrolysis zone A, a cylinder 1*a* of soft iron, having a height of 1.54 m and a diameter of 0.5 m, was connected at a circumferential joint flange, to form the intermediate reaction zone B. The cathode vessel 24 and the cylinder 1*a* were electrically connected by four copper strips 26 located around the cylinder 1*a* at the joint flange. The copper strips 26 have a width of 10 cm and a thickness of 5 mm.

In the cylinder 1*a*, the draft tube 19 of titanium, having a height of 2.2 m, a thickness of 0.5 mm and a diameter of 0.1 m, was disposed coaxially with the cylinder 1*a* and was connected to the chute 18.

As the upper gas-separation zone C, a cylinder of titanium having a closed top end, with a diameter of 0.45 m and a height of 1.2 m, was connected to the lower cylinder forming the reaction zone B.

The outlet pipe 22, for discharging the output solution from the column, and the draft tube 19 were designed so that the electrolyte solution during the operation had a free surface S, in the space defined by the column wall and draft tube, positioned 0.3 m below the top wall of the column, and the upper open end of the draft tube was positioned 0.2 m below the level of the liquid free surface S. The entire arrangement was insulated thermally so as to prevent the temperature of the liquid from being lowered, due to the radiation of thermal energy.

The above apparatus was operated with: a current of 12,000 A (anode current density of 25 $A/dm^2$, current concentration of 19.6 A/l); with a starting chloride solution or feed brine, having a composition of 290 g/l of NaCl, 94 g/l of $NaClO_3$, 7.6 g/l of $Na_2CrO_4$ and water, fed at a feeding rate of 23.2 kg/h; a dosing solution containing 140 g/l of hydrochloric acid fed at a feeding rate of 1 kg/h; and water fed at a feeding rate of 3.5 kg/h, while the output solution having a composition of 97 g/l of NaCl, 639 g/l of $NaClO_3$ and 8.9 g/l of $Na_2CrO_4$ and a pH value of 5.9 was removed at a discharging rate of 20.7 kg/h. The amount of $NaClO_3$ produced by the electrolysis operation was 7.5 kg/h. The operation was continued for about 10 months at a liquid temperature of 95° to 110° C. and at a pH value of 5.9.

As a result, the following high performances were obtained: The average current efficiency was 95.6%, the average electrolysis voltage was 2.82 V and the average electric power for electrolysis per unit of production was 4450 KWH(D.C.)/ton. In connection with this, it should be noted that the operation was carried out with the electrolyte including hypochlorous acid having a reduced concentration of 0.42 g/l (calculated on the basis of HClO).

The inventors carried out the below-mentioned experiments in order to investigate preferable and critical conditions regarding the temperature, the pH value and cathodic protection. In these experiments, the apparatus had the same arrangement and dimensions as that of the above example, except for the following. The titanum draft tube 19 was provided with a jacket, having a diameter of 15 cm, in which cooling and heating means were provided, so that the temperature of the liquid in the intermediate reaction zone could be adjusted.

EXPERIMENT 1

In order to examine the effect of the temperature on the liquid, the above mentioned apparatus was operated with a current of 12,000 A to produce an output solution, having a composition of 105 g/l of NaCl, 480 g/l of $NaClO_3$ and 7.5 g/l of $Na_2CrO_4$ at a pH value of 6.0 under various temperature conditions.

The results are indicated in Table I.

In the above operation, the content of $Cl_2$ in the generated gases is increased as the temperature becomes higher. For example, at 110° C., the Cl content reached 1.5%. However, such chlorine was captured in a subsequent gas-purification process and was recovered in the form of $NaClO_3$ to be returned to the electrolysis system.

In this respect, the recovered chlorine gas was taken into consideration as an effective material, when calculating the current efficiency, not a lost material.

TABLE I

| Temperature (°C.) | Current Efficiency % | Voltage (V) | Electric Power per unit product KWH(D.C)/ton($NaClO_3$) |
|---|---|---|---|
| 80 | 96.5 | 2.99 | 4680 |
| 90 | 95.7 | 2.90 | 4580 |
| 100 | 95.4 | 2.79 | 4420 |
| 110 | 94.9 | 2.71 | 4310 |

As apparent from Table I, electrolysis with the auto-oxidation of hypochlorous acid at a high temperature of 80° to 110° C. can be carried out with a reduced electric power per unit product of $NaClO_3$, in comparison with a conventional box type apparatus. According to the conventional apparatus, the optimum results were as follows:

| | |
|---|---|
| Current Efficiency | 90% |
| Voltage | 3.2 V |
| Electric Power per unit | 5370 KWH/ton |

EXPERIMENT 2

In order to examine the effect of the pH value, the apparatus of Experiment 1 was conducted, as in Experiment 1, with a current of 12,000 A at a temperature of 105° C. under various pH conditions, to produce an output solution having a composition of 103 g/l of NaCl, 624 g/l of $NaClO_3$ and 8.1 g/l of $Na_2CrO_4$. During the procedure, the electrolysis voltage was kept constantly at a value of 2.78 V. The results are indicated in Table II.

In calculating the current efficiency, the amount of chlorine gas generated was taken into consideration, for the reason set forth in Experiment 1.

TABLE II

| pH | Current Efficiency | Electric Power per Unit KWH(D.H)/ton ($NaClO_3$) | Content of $Cl_2$ in Generated gased (%) |
|---|---|---|---|
| 5.5 | 95.9 | 4380 | 2.6 |
| 5.8 | 95.7 | 4390 | 1.7 |
| 6.1 | 95.3 | 4410 | 1.2 |
| 6.4 | 94.6 | 4450 | 0.4 |
| 6.7 | 93.3 | 4500 | 0.3 |

Referring to Table II, at a pH value of 5.5, the $Cl_2$ content in the produced gases became so large that the load of the gas-purification process was greatly increased. The load of the purification process was reduced as the pH value was reduced.

EXPERIMENT 3

In order to examine the cathodic protection in the electrolysis process, the apparatus of Experiment 1 was operated, as in Experiment 1, at a temperature of 90° C. under various concentrations of $Na_2CrO_4$ and various currents. The amount of corrosion was calculated from the content of Fe dissolved in the solution.

The concentration of hypochlorous acid was changed according to the current density, but in the range of from 0.31 to 0.48 g/l (calculated on the basis of HClO).

The results regarding the corrosion amount of Fe are indicated in Table III.

TABLE III (unit: mm/year)

| Concentration of $Na_2CRO_4$ (g/l) | Anode Current Density ($A/dm^2$) 5 | 10 | 20 | 30 |
|---|---|---|---|---|
| 2.2 | 1.40 | 0.47 | 0.031 | 0.054 |
| 4.7 | 0.37 | 0.068 | 0.015 | 0.008 |
| 9.0 | 0.15 | 0.013 | 0.004 | 0.007 |

Referring to Table III, the anti-corrosion effect was enhanced as the concentration of $Na_2CrO_4$ and the anode current density were increased. From these data, it was confirmed that effective anti-corrosion can be attained, provided that the apparatus is operated at a concentration of $Na_2CrO_4$ not less than 4.7 g/l and an anode density not less than 10 $A/dm^2$.

As a matter of fact, the corrosion of Fe greatly relies on the concentration of hypochlorous acid. However, according to the present invention, since the apparatus can be designed so as to be operated at a very high temperature and a reduced pH value, the concentration of hypochlorous acid is considerably reduced with the result that effective anti-corrosion is definitely attained, even if the apparatus is made mainly of soft iron.

We claim:

1. In an apparatus for electrolytically producing alkaline chlorates from a starting solution, comprising a container of a column type forming a lower electrolysis zone having an electrode section and a feed section; an intermediate reaction zone having an elevating section and a descending section, in combination, forming a reactor; and an upper gas-separation zone, said electrode section comprising vertical cathode plates and anode plates mounted to said column and arranged alternately and spaced apart from the neighboring plates, and having a horizontal straight passage therethrough, said feed section being defined by said electrode section and the side and bottom walls of said column to form two symmetrical opposite areas outside of said electrode section, which areas are in communication with each other through said horizontal straight passage, said elevating section being defined by a vertical tube extending axially within said column, said tube having upper and lower open ends with an enlarged lower portion of a reverse funnel form covering the top area of said electrode section, said descending section being defined by said tube and the side wall of said column to form a space extending vertically around said tube and having an inlet for introducing starting solution and an outlet for discharging solution out of said column, said descending section communicating with said feed section at the top thereof, said upper zone being defined by the side and top walls of said column to form a space communicating with said elevating and descending sections, said upper zone having an outlet at the top wall of said column for discharging gases produced from the solution in said column, the improvement comprising in combination:

(A) said column consisting of three separate cylindrical segments corresponding to said lower zone, said intermediate zone, and said upper zone, respectively, said column segments being connected detachably by bolt-nut means at their joints, the joints between said lower and intermediate segments being electrically connected by a copper strip;

(B) said anode plates being grouped in two combinations forming a pair of combs located oppositely in such arrangement that corresponding anode plates of said opposite combs extend inwardly in opposite directions, and the inner ends of the corresponding opposite anode plates are spaced apart from each other;

(C) said cathode plates extending upwardly from the bottom wall of said column and being spaced apart from the neighboring plates without any spacers, each cathode plate having a horizontal hole defined by it and said column bottom wall, said holes forming, in combination, said horizontal straight passage across said electrode section, said anode plates having lower free ends positioned above said horizontal staight passage;

(D) said lower and intermediate column segments having substantially the same inner diameter over their axial length, said lower column segment having opposite holes open to the opposite sides of the segment wall and having opposite hollow extensions extending straight-outwardly from said corresponding sides to surround said segment holes, thereby to form opposite inlets for said anode combs to be introduced into said column therethrough;

(E) said upper column segment forming said upper gas-separation zone having a diameter smaller than that of said lower and intermediate column segments, and being detachably connected to said intermediate column segment;

(F) said tube defining said elevating section having an upper cylindrical portion allowing the solution to flow therethrough in a piston flow, while said cylindrical intermediate column segment and said upper cylindrical-tube portion, in combination, define said descending section of a circumferential form which allows the solution to flow therethrough in a piston flow;

(G) said enlarged lower portion of said tube being mounted onto the opposite outermost cathode plates at the opposite upper corners thereof; and (H) a ratio of a height of said column to the diameter of said intermediate reaction zone being not less than 2.

2. An apparatus as claimed in claim 1, wherein said column has a conduit for dosing hydrochloric acid, extending from the top wall of said column into said upper zone, said conduit having an inner open end being positioned on the axis of said column and spaced apart from the upper open end of said tube.

3. An apparatus as claimed in claim 2, wherein said anode combs are detachably mounted to said column, but electrically insulated from said column.

4. An apparatus as claimed in claim 1, 2, or 3, wherein a cylindrical vessel having a lower closed end and an upper open end is mounted on said tube at its lower end so as to coaxially enclose said tube, thereby to form a circumferential inner local passage, said vessel having equiangularly spaced openings open to the cylindrical wall of said vessel at the lower end thereof, vertically extending partitions of a semi-circular cross section being mounted onto the cylindrical wall of said vessel outside thereof to form semi-circular intermediate local passages having lower closed ends and upper open ends, in such arrangement that said inner and intermediate local passages communicate with each other through said openings of said vessel wall, wherein said upper open end of said vessel is in a position higher than those of said upper open ends of said tube and said intermediate local passages, and said column, said vessel and said partitions define an outer circumferential passage communicating with said intermediate local passages at the open end thereof.

* * * * *